US006220308B1

(12) United States Patent
Speich

(10) Patent No.: US 6,220,308 B1
(45) Date of Patent: Apr. 24, 2001

(54) DEVICE FOR STRETCHING AND TENSIONING A WEFT YARN

(75) Inventor: Francisco Speich, Gipf-Oberfrick (CH)

(73) Assignee: Textilma, AG, Hergiswil (CH)

( * ) Notice: Subject to any disclaimer, the term of this patent is extended or adjusted under 35 U.S.C. 154(b) by 0 days.

(21) Appl. No.: 09/462,121

(22) PCT Filed: May 27, 1998

(86) PCT No.: PCT/CH98/00223

§ 371 Date: Jan. 3, 2000

§ 102(e) Date: Jan. 3, 2000

(87) PCT Pub. No.: WO99/01599

PCT Pub. Date: Jan. 14, 1999

(30) Foreign Application Priority Data

Jul. 1, 1997 (DE) ..... 197 28 013

(51) Int. Cl.[7] ..... D03D 47/30
(52) U.S. Cl. ..... 139/194
(58) Field of Search ..... 139/194, 435.5, 139/435.6

(56) References Cited

U.S. PATENT DOCUMENTS 3,744,533 7/1973 Yano et al. .
4,487,236 * 12/1984 Gunneman ..... 139/435.5
4,838,321 6/1989 Ishido et al. .
5,224,521 * 7/1993 De Jager ..... 139/194
5,226,458 * 7/1993 Bamelis ..... 139/194
5,333,651 * 8/1994 Riezler ..... 139/194
5,735,316 * 4/1998 Hehle ..... 139/194

FOREIGN PATENT DOCUMENTS 4118411 8/1992 (DE) .
4443371 1/1996 (DE) .
2971148 9/1997 (DE) .
2353664 12/1977 (FR) .
2497841 7/1982 (FR) .
2081753 2/1982 (GB) .

* cited by examiner

*Primary Examiner*—Andy Falik
(74) *Attorney, Agent, or Firm*—Brown & Wood, LLP

(57) ABSTRACT

An apparatus for stretching and tensioning of a weft thread including a nozzle (6) for producing an air flow directed substantially transversely to a weft direction for deflecting a weft thread with respect to the weft direction; and a reception channel (8) for reception of a deflected weft thread, which is arranged at a distance from the nozzle with the nozzle (6) having at least one nozzle hole (14) and with the nozzle (6) being adjustably arranged in the weft direction relation to the reception channel (8).

8 Claims, 4 Drawing Sheets

DEVICE FOR STRETCHING AND TENSIONING A WEFT YARN

BACKGROUND OF THE INVENTION

1. Field of the Invention

The invention relates to an apparatus for the stretching and tensioning of a weft thread for an air jet loom in accordance with the preamble of claim 1 and to a loom with such an apparatus.

2. Description of the Prior Art

In DE-A-32 00 637 an air jet loom is described having a weft thread monitor and a clamping apparatus for the stretching and holding taut of a weft thread up to beat-up. This apparatus has a body with a half open recess the one boundary surface of which has an air entry opening and the other boundary surface of which has an air outlet opening. The two openings lie opposite to one another and are connected to an air supply line and/or to an air suction line respectively so that an air flow can be produced in the recess transverse to the weft direction. Through this air flow the end section of a weft thread to be inserted is engaged after flying through the thread monitor and deflected into the air suction line. It has proved to be a disadvantage of these devices that only a directed air jet is provided for the thread deflection.

The invention is based on the object of improving the stretching and tensioning of a weft thread.

SUMMARY OF THE INVENTION

This and other objects of the present inveniton, which will become apparent hereinafter, are achieved by providing a nozzle having at least one nozzle hole and which is adjustably arranged in the weft direction relative to a closed channel for reception of a deflected web thread.

The invention has the advantages that, on the one hand, the nozzle produces two air jets which form an air curtain and that, on the other hand, the nozzle is adjustable relative to the channel. In this way a thread deflection is guaranteed independent of the type of thread and the weft thread is held reliably taut.

In the following the invention will be explained with reference to the accompanying drawings.

BRIEF DESCRIPTION OF THE DRAWINGS

There are shown.

DETAILED DESCRIPTION OF THE PREFERRED EMBODIMENT

Figure 1:
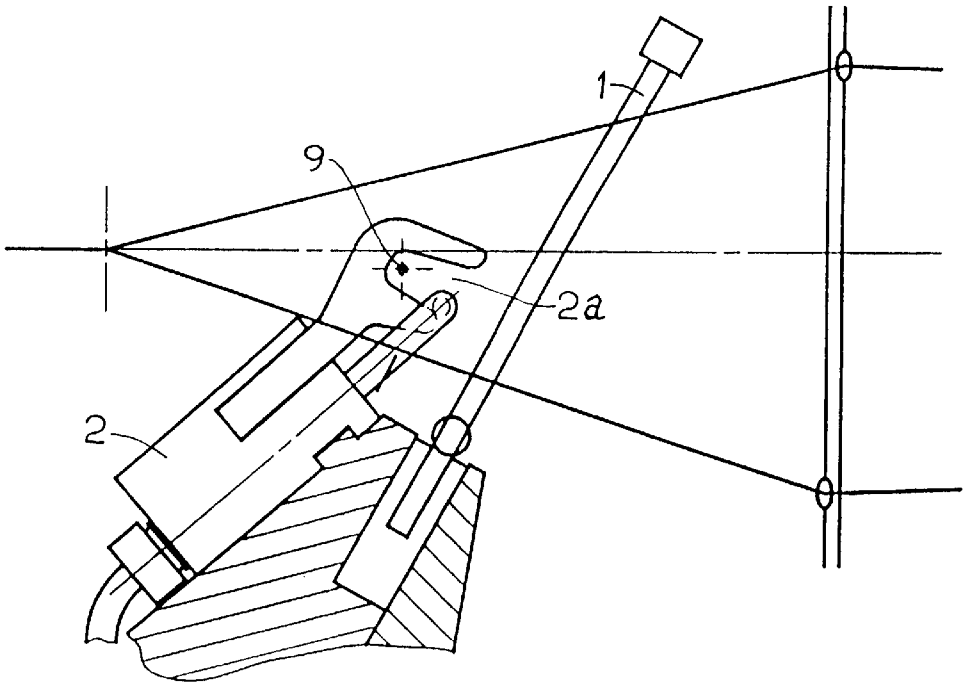
FIG. 1 the position of the reed during the weft insertion.
Figure 3:
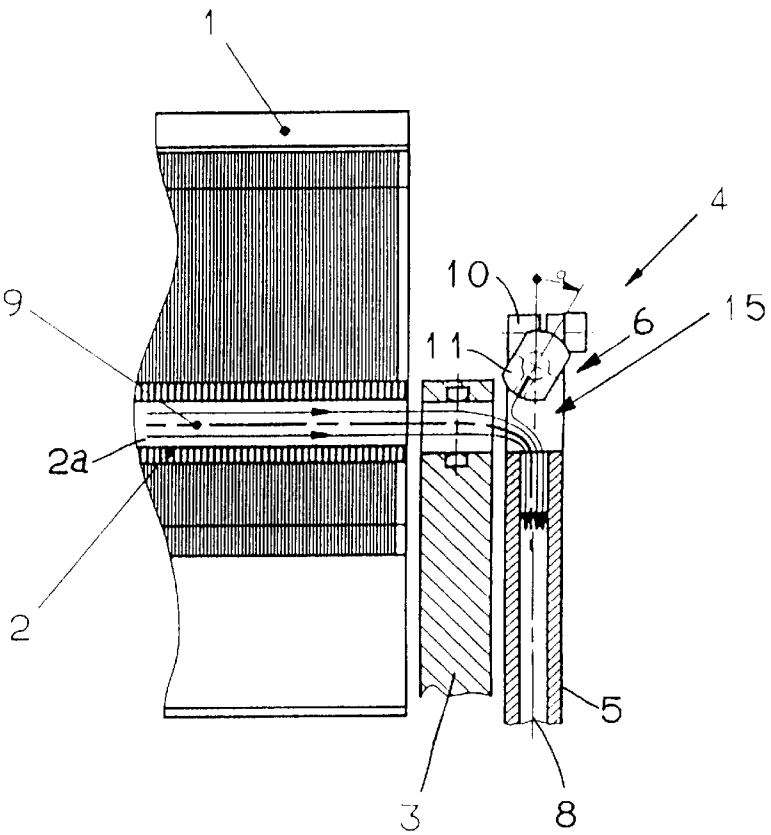
Figure 2:
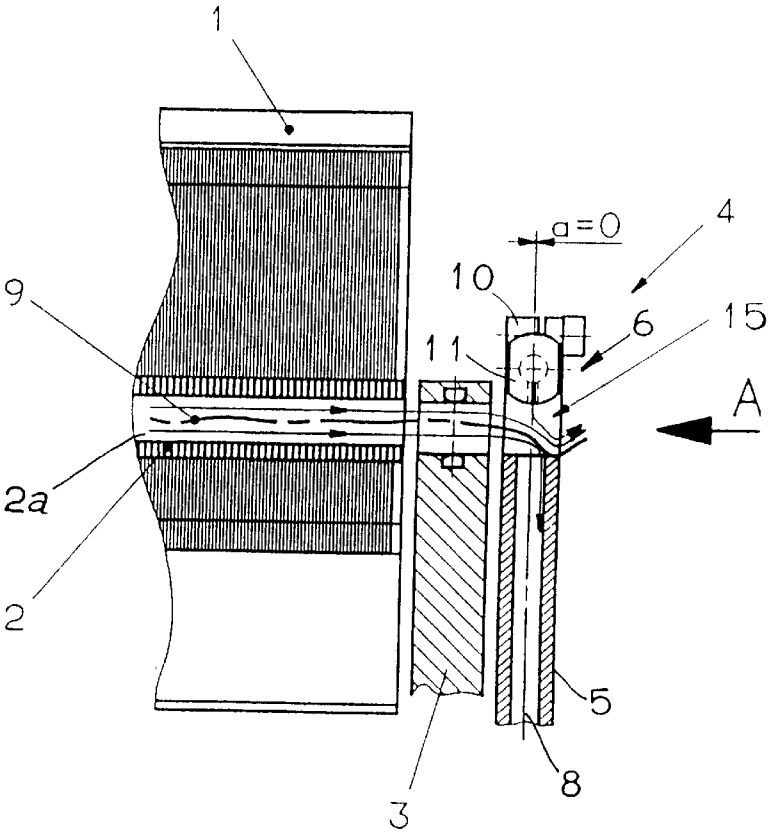
FIG. 2 a section of a portion of a weft channel at the capture side of an air jet loom with a first embodiment of an apparatus in accordance with the invention, FIG. 3 the apparatus shown in FIG. 2 with the nozzle pivoted, FIG. 4 a partly broken open view of the apparatus in the direction of the arrow A in FIG. 2, FIG. 5 a section of a portion of a weft channel at the capture side of an air jet loom with a second embodiment of an apparatus in accordance with the invention, FIG. 6 the apparatus shown in FIG. 5 with offset nozzle and FIG. 7 a partly broken open view of the apparatus in the direction of the arrow A in FIG. 5.

FIG. 1 shows a position of reed 1 with respect to a guide device 2 having a guide channel 2*a* for insertion of a weft thread 9. As shown in FIGS. 2–3, at the capture side of the loom, there are arranged, in the weft direction after the reed 1 and the guide device 2, a weft thread monitor 3 and a stretching and tensioning apparatus 4.

Figure 4:
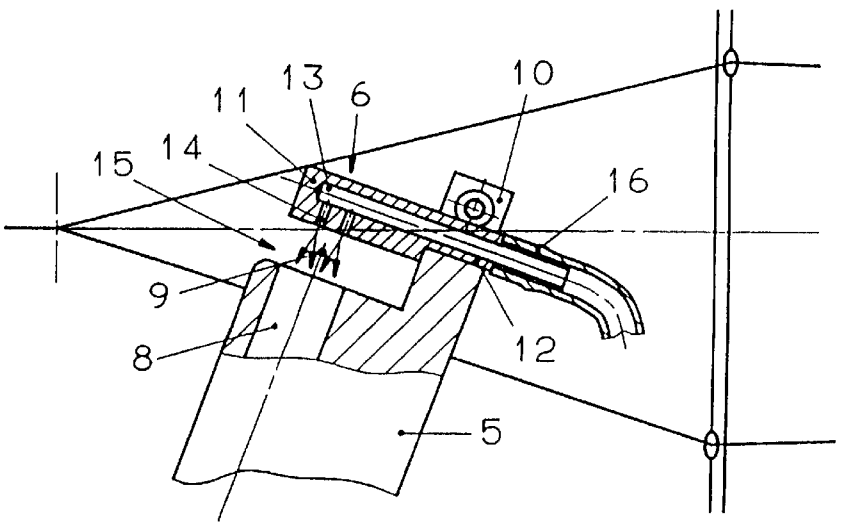

FIG. 4 shows the stretching and tensioning apparatus 4 according to the present invention. The apparatus 4 includes a nozzle holder 5 and a nozzle 6 which is mounted on the nozzle holder. The nozzle holder 5 has a through-bore 8 which forms a channel for the reception of a weft thread 9 and a projection 10 which has a slotted bore for the reception of the nozzle 6. The nozzle 6 comprises a body 11 with a cross-section resembling a rectangle with parallel long sides and rounded narrow sides (FIG. 4) and a cylindrical projection 12. In the nozzle there are formed a blind bore 13 and two nozzle holes 14 which are arranged parallel to one another and open out in the rounded side. The nozzle is rotatably mounted in the holder and secured by a non-illustrated screw. In this way a half-open recess 15 is formed which is aligned with the guide channel 2*a*. The nozzle 6 is connected to a line 16 for the supply of air.

In FIG. 4 the nozzle 6 is shown in a position in which the nozzle holes are aligned with the channel and analogously to the prior art. As a result of the intersecting air jets the known problems arise. If the conveying air flow for the weft thread is stronger than the air flow from the nozzle 6 the weft thread 9 is not correctly deflected and tensioned. If the air flow from the nozzle 6 is stronger the conveying air flow for the weft thread, then the weft thread is already deflected prior to reaching the apparatus. Thus the intersecting air flows must be matched to one another which is very complicated. In the first embodiment of the apparatus this matching of the air flows is facilitated in an advantageous manner by pivoting of the nozzle 6 and thus of the air curtain that is produced (FIG. 3).

Figure 7:
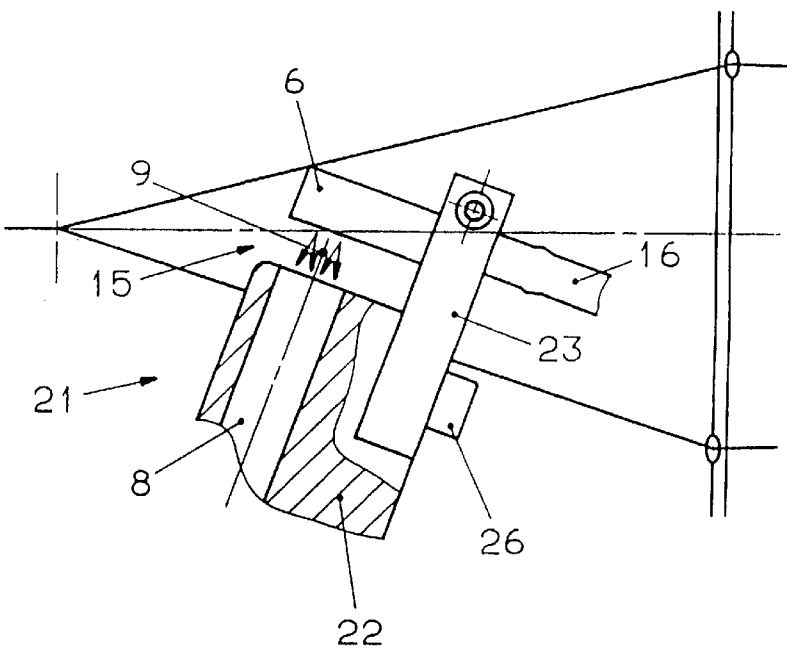
Figure 6:
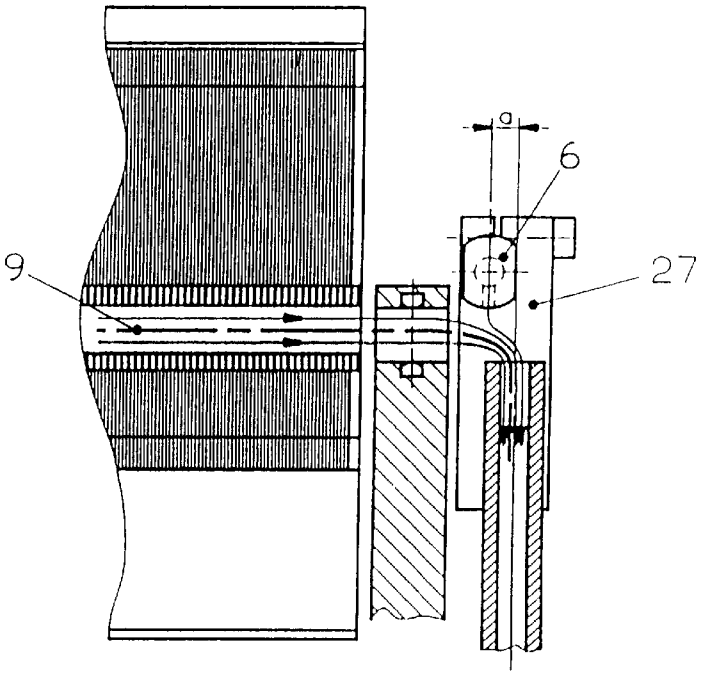
Figure 5:
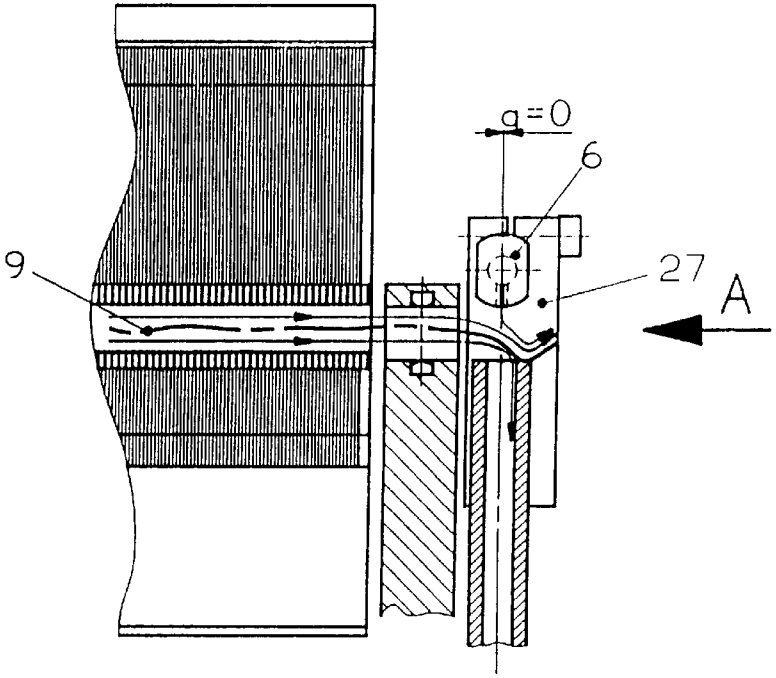

The FIGS. 5 to 7 show a second embodiment of the apparatus. As FIG. 7 shows a nozzle holder 21 is subdivided in this apparatus into a basic body 22 with the channel 8 and a plate-like holding element 23 for the nozzle 6. The holding element 23 is provided with a slotted bore in which the nozzle 6 is arranged and it can be secured to the base body by means of the screw 26. As FIG. 7 shows the holding element 23 is so arranged that on the one end the half-open recess 15 is formed and on the other hand the nozzle openings of the nozzle 6 are aligned with the opening of the channel 8. In the position of FIG. 5 the above explained problems arise which are however overcome by the pivoting of the nozzle 6 in accordance with FIG. 6. In FIG. 6 the second embodiment of the apparatus is so arranged that on the one hand the half-open recess is formed and on the other hand the nozzle openings of the nozzle 6 are displaced opposite to the weft direction relative to the opening of the channel 8.

As already mentioned the nozzle holes 14 are arranged parallel to one another. If air is supplied to the nozzle 6 then an air curtain is produced by means of these nozzle holes 14. This air curtain extends transverse to the air conveying flow for a weft thread. Through this air curtain the conveying air flow for the weft thread and thus also the weft thread is urged towards the channel opening and directed into the channel 8. In this way the weft thread is held stretched and tensioned in an advantageous manner both by the air flow from the nozzle and also by the conveying air flow for the weft thread. The apparatus has a nozzle holder 5 with a channel 8 for the reception of a weft thread and a nozzle 6 with nozzle holes 14 for the stretching and tensioning of the weft thread. The nozzle 6 is mounted on the nozzle holder in such a way that the nozzle is adjustable relative to the weft direction and is in particular pivotable or displaceable. With this apparatus the ideal setting of the crossing air flows is facilitated in an advantageous manner and a deflection of the weft thread 9 is ensured independently of the nature of the thread and the weft thread is held reliably taut.

What is claimed is:

1. Apparatus for stretching and tensioning of a weft thread for an air jet loom, comprising a nozzle (6) for producing an air flow directed substantially transversely to a weft direction for deflecting the weft thread with respect to the weft direction; and a reception channel (8) for reception of a deflected weft thread, which is arranged at a distance from the nozzle, and wherein the nozzle (6) is adjustably arranged in the weft direction relative to the reception channel (8), and wherein the nozzle (6) is provided with two nozzle holes (14) in order to produce one of two parallel airjets and two diverging airjets.

2. Apparatus in accordance with claim 1, wherein the nozzle (6) is one of the displaceably arranged and pivotally arranged with respect to a mouth of the reception channel (8).

3. Apparatus for stretching and tensioning of a weft thread for an air jet loom, comprising a nozzle (6) for producing an air flow directed substantially transversely to a weft direction for deflecting the weft thread with respect to the weft direction; and a reception channel (8) for reception of a deflected weft thread, which is arranged at a distance from the nozzle, wherein the nozzle (6) has at least one nozzle hole (14), and wherein the nozzle (6) is adjustably arranged in the weft direction relative to the reception channel (8), and wherein the apparatus further comprises a nozzle holder (5) in which the reception channel (8) is formed and a holding section (10) for the nozzle (6), with the holding section having a slotted bore for receiving the nozzle (6) and means for fixing the nozzle in the bore.

4. Apparatus in accordance with claim 3, wherein the nozzle (6) has a nozzle body (11) with a cylindrical projection (12) rotatably mounted in the holding section (10) of the nozzle holder (5).

5. Apparatus in accordance with claim 3, wherein the nozzle (6) has a rectangular nozzle body (11) having parallel long sides, rounded narrow sides and a cylindrical projection (12), wherein the nozzle hole (14) opens at a narrow side, and wherein the nozzle body (11) is mounted in the holding section (10) of the nozzle holder (5) for rotation about an axis of the projection 12 so that the nozzle hole (14) is aligned with a mouth of the reception channel (8).

6. Apparatus for stretching and tensioning of a weft thread for an air jet loom, comprising a nozzle (6) for producing an air flow directed substantially transversely to a weft direction for deflecting the weft thread with respect to the weft direction; and a reception channel (8) for reception of a deflected weft thread, which is arranged at a distance from the nozzle, wherein the nozzle (6) has at least one nozzle hole (14), and wherein the nozzle (6) is adjustably arranged in the weft direction relative to the reception channel (8), and wherein the apparatus further comprises a nozzle holder (21) which has a basic body (22), with the reception channel (8) being formed in the basic body, and a holding element (23).

7. Apparatus in accordance with claim 6, wherein the nozzle (6) has a nozzle body (11) with a cylindrical projection (12) rotatably mounted in the holding element (23).

8. Air jet loom, comprising a reed (1) with a guide element (2) having a guide channel **(2*a*); a weft thread monitor (3) arranged downstream of the reed (1) in the weft direction; and an apparatus for stretching and tensioning of a weft thread, the apparatus comprising a nozzle (6) for producing an air flow directed substantially transversely to a weft direction for deflecting a weft thread with respect to the weft direction; and a reception channel (8) for reception of a deflected weft thread, which is arranged at a distance from the nozzle, wherein the nozzle (6) has at least one nozzle hole (14), wherein the nozzle (6) is adjustably arranged in the weft direction relative to the reception channel (8), and wherein the at least one nozzle hole (14) is aligned with the reception channel (8)**.

* * * * *